US011107447B2

(12) United States Patent
Agnello

(10) Patent No.: US 11,107,447 B2
(45) Date of Patent: Aug. 31, 2021

(54) MUSICAL INSTRUMENT TUNER

(71) Applicant: Eventide Inc., Little Ferry, NJ (US)

(72) Inventor: Anthony M. Agnello, Princeton, NJ (US)

(73) Assignee: Eventide Inc., Little Ferry, NJ (US)

( * ) Notice: Subject to any disclaimer, the term of this patent is extended or adjusted under 35 U.S.C. 154(b) by 0 days.

(21) Appl. No.: 16/636,229

(22) PCT Filed: Aug. 3, 2018

(86) PCT No.: PCT/US2018/045214
§ 371 (c)(1),
(2) Date: Feb. 3, 2020

(87) PCT Pub. No.: WO2019/028384
PCT Pub. Date: Feb. 7, 2019

(65) Prior Publication Data

US 2020/0372881 A1 Nov. 26, 2020

Related U.S. Application Data

(60) Provisional application No. 62/541,429, filed on Aug. 4, 2017.

(51) Int. Cl.

| | |
|---|---|
| ***G10G 7/02*** | (2006.01) |
| ***G10H 1/00*** | (2006.01) |
| ***H04R 1/24*** | (2006.01) |

(52) U.S. Cl.
CPC ..... *G10G 7/02* (2013.01); *G10H 1/0008* (2013.01); *H04R 1/24* (2013.01); *G10H 2220/525* (2013.01)

(58) Field of Classification Search
CPC ..... G10G 7/02
See application file for complete search history.

(56) References Cited

U.S. PATENT DOCUMENTS

| | | | | | |
|---|---|---|---|---|---|
| 796,289 | A * | 8/1905 | Shutt | G10G 7/02 | 84/454 |
| 834,416 | A * | 10/1906 | Brady | G10G 7/02 | 84/454 |
| 841,384 | A * | 1/1907 | England | G10G 7/02 | 84/454 |
| 1,366,735 | A * | 1/1921 | Kratt | G10G 7/02 | 84/456 |
| 1,796,795 | A * | 3/1931 | Kratt | G10G 7/02 | 84/456 |

(Continued)

OTHER PUBLICATIONS

International Search Report including the Written Opinion for Application No. PCT/US2018/045214 dated Oct. 3, 2018, 16 pages.

(Continued)

*Primary Examiner* — Robert W Horn
(74) *Attorney, Agent, or Firm* — Lerner, David, Littenberg, Krumholz & Mentlik, LLP

(57) ABSTRACT

A frequency detection and display device includes a body having a vibratory portion configured for vibrating at a predetermined frequency. In this manner, the vibratory portion provides a visible indication corresponding to the predetermined frequency in response to vibration of an object, such as a stringed musical instrument, to which the frequency detection and display device is attached.

17 Claims, 4 Drawing Sheets

(56) References Cited

U.S. PATENT DOCUMENTS 2,390,237 A * 12/1945 Bryant ..... G10G 7/02 84/456
2,445,304 A * 7/1948 Grace ..... G01P 3/14 356/25
2,514,315 A * 7/1950 Dickerson ..... G10G 7/02 84/454
2,779,920 A * 1/1957 Merlin ..... G01R 23/02 324/76.49
2,837,954 A * 6/1958 Kratt ..... G10G 7/02 84/456
3,339,446 A * 9/1967 Gantz ..... G10G 7/02 84/456
3,421,402 A * 1/1969 Musser ..... G10G 7/02 84/455
3,691,894 A * 9/1972 Schneider ..... G10G 7/02 84/454
3,861,213 A * 1/1975 Parker ..... G01K 11/165 374/161
3,898,354 A * 8/1975 Parker ..... G01K 1/028 427/256
3,901,120 A * 8/1975 Youngquist ..... G10G 7/02 84/454
3,965,742 A * 6/1976 Parker ..... G01K 1/028 374/161
4,061,071 A * 12/1977 Cameron ..... G10G 7/02 84/455
4,150,570 A * 4/1979 Fuller ..... G01W 1/11 116/200
4,198,861 A * 4/1980 Mung-Kuen Luk ..... G01K 11/165 374/162
4,335,642 A * 6/1982 Pogoda ..... G10G 7/02 362/293
4,365,537 A * 12/1982 Pogoda ..... G10D 3/173 84/454
4,589,324 A * 5/1986 Aronstein ..... G10G 7/02 84/454
4,738,549 A * 4/1988 Plimpton ..... G01K 1/08 349/162
5,036,742 A * 8/1991 Youakim ..... G04F 5/025 84/411 R
5,060,524 A * 10/1991 Artola ..... A63B 51/005 73/862.41
5,549,028 A * 8/1996 Steinberger ..... G10G 7/02 84/454
5,738,442 A * 4/1998 Paron ..... G01K 11/165 374/150
5,854,437 A * 12/1998 Merrick ..... G10G 7/02 84/454
6,066,790 A * 5/2000 Freeland ..... G10G 7/02 84/453
6,544,614 B1 * 4/2003 Huffer ..... G01K 11/12 428/40.1
6,965,067 B2 * 11/2005 Kondo ..... G10G 7/02 84/454
7,049,502 B2 * 5/2006 Taku ..... G10G 7/02 84/454
7,285,710 B1 * 10/2007 Wallace ..... G10G 7/02 84/454
7,390,951 B2 * 6/2008 Dulaney ..... G10G 7/02 84/454
7,875,784 B2 * 1/2011 Moyle ..... G10G 7/02 84/454
8,003,874 B2 * 8/2011 Asakura ..... G10G 7/02 84/613
8,811,121 B2 * 8/2014 Balli ..... G04G 99/00 368/10
9,058,798 B2 * 6/2015 Walker ..... G10K 11/04
9,064,479 B2 * 6/2015 Yui ..... G10G 7/02
9,117,433 B2 * 8/2015 Yui ..... G10H 1/44
9,443,497 B1 9/2016 Membreno et al.
9,857,237 B2 * 1/2018 Astorino ..... G01K 11/165
9,967,639 B2 * 5/2018 FallHowe ..... G10H 1/32
2004/0237255 A1 * 12/2004 Lin ..... E05B 1/0069 16/110.1
2008/0142529 A1 * 6/2008 LaGuardia ..... G01K 11/165 220/592.2
2008/0229906 A1 9/2008 Kwak et al.
2009/0056523 A1 * 3/2009 Park ..... G10G 7/02 84/455
2009/0295383 A1 12/2009 Gianchandani et al.
2010/0236380 A1 * 9/2010 Miele ..... G10G 7/02 84/454
2011/0197743 A1 * 8/2011 Potter ..... G10G 7/02 84/730
2012/0067192 A1 * 3/2012 Nielsen ..... G10G 7/02 84/454
2013/0112063 A1 * 5/2013 Nielsen ..... G10H 1/44 84/454
2013/0155715 A1 * 6/2013 Kim ..... G02B 6/04 362/553
2013/0194219 A1 8/2013 Modarres et al.
2015/0082970 A1 3/2015 Chekardzhikov
2020/0372881 A1 * 11/2020 Agnello ..... G10H 1/0008

OTHER PUBLICATIONS

Lapedus, "Atomic Layer Etch Finally Emerges", Semiconductor Engineering Deep Insights for the Tech Industry, May 15, 2014, pp. 1-11, Retrieved Online May 4, 2020: https://semiengineering.com/atomic-layer-etch-finally-emerges/.

* cited by examiner

MUSICAL INSTRUMENT TUNER

CROSS-REFERENCE TO RELATED APPLICATIONS

The present application is a national phase entry under 35 U.S.C. § 371 of International Application No. PCT/US2018/045214 filed Aug. 3, 2018, published as WO 2019/028384 A1, which claims priority from U.S. Provisional Patent Application No. 62/541,429 filed Aug. 4, 2017, the disclosure of all of which hereby being incorporated herein by reference.

BACKGROUND OF THE INVENTION

Users of tunable musical instruments such as guitars, violins, mandolins, pianos, etc. know the importance of tuning their instrument and keeping them in tune. Many such users purchase battery or DC-powered tuners that can clip into the instrument or that can accept a cable input from an instrument such as an electric guitar in order to tune the instrument. Such tuners are sensitive devices that detect small differences in vibrations from musical instruments to indicate to the user of the tuner whether a given string or note is in tune.

These musical instrument tuners require power from power components that require replacement, e.g., batteries, power supplies, etc. in order to operate. Replacement of these components adds cost, is an inconvenience, and can interrupt the use of musical instruments, such as in a live setting and detract from the overall enjoyment of such instruments. In addition, batteries require special disposal to prevent environmental contamination. As the power provided by batteries or other non-utility sourced power supplies is limited, backup power supplies must be acquired and carried in conjunction with current musical instrument tuners.

Musical instrument tuners require displays attached to the sensors that detect the vibration from the instrument in order to provide the usable feedback to the user. These tuners also require receptacles to receive the non-utility sourced power supplies. These additional components add bulk to the tuners reducing the options for inconspicuous placement of the tuners and creating the need for strong attachment devices such as unsightly clips that users often attach to the instrument being tuned, e.g., to the head or neck of a guitar. Due to their bulk, musical instrument tuners need to be separated from the instrument either while playing or after playing the instrument and stored appropriately to avoid losing or damaging the musical instrument tuner.

Accordingly, there is a need for tuning musical instruments that improves over these shortcomings and eliminates the need for external power components and batteries.

SUMMARY OF THE INVENTION

In accordance with an aspect of the technology, a frequency detection and display device may be attachable to a tunable musical instrument with an instrument surface that vibrates at different frequencies during tuning of the instrument. The device may include a body that may include one or more vibratory portions that may be configured for vibrating at one or more predetermined frequencies and thereby may provide visible indications corresponding to the respective one or more predetermined frequencies in response to vibration of the instrument surface during the tuning of the instrument.

In some arrangements, the one or more vibratory portions of the body may have either or both one or more different physical properties and one or more different chemical properties than a part of the body adjacent to the vibratory portions. In some arrangements, the one or more vibratory portions may have a different density than a part of the body adjacent to the one or more vibratory portions. In some arrangements, the one or more vibratory portions may have different thicknesses. In some such arrangements, the one or more vibratory portions and a part of the body adjacent to any such vibratory portion may have thicknesses that differ by 20 nm or less, and in some such arrangements, may have thicknesses that differ by 10 nm or less.

In some arrangements, the one or more vibratory portions of the body may define a groove in or embossment of the body. In some arrangements, the groove or embossment may be in the shape of a letter. In some arrangements, the groove or embossment may be in the shape of an oval, a line, or a polygon. In some arrangements, the groove or embossment may be curvilinear.

In some arrangements, the one or more vibratory portions of the body may be formed by removing material from an in-process body using atomic layer etch (ALE), also known as atomic level etch, or using an atomic level chemical etching process. In some arrangements, the one or more vibratory portions may be formed by the removal of at least two layers using ALE. In some arrangements, the one or more vibratory portions of the body may be formed by adding a precise amount of material to an in-process or existing surface of the body using atomic layer deposition (ALD).

In some arrangements, the frequency detection and display device may include an intermediate attachment device that may be attached to the body and that may be configured for attachment to the musical instrument. In some arrangements, the body may be in the form of a patch.

In some arrangements, the frequency detection and display device may include a light-emitting device that may be attached to the body. The light-emitting device may contact one of the vibratory portions of the body such that vibration at a predetermined frequency of a part of the body intersecting such vibratory portion of the body may vibrate such vibratory portion and thereby cause such the light-emitting device to emit a light. In some arrangements, a plurality of light-emitting devices may contact a respective plurality of the vibratory portions in this manner such that a first light is emitted from a first light-emitting device of the plurality of light-emitting devices as a first color to a naked human eye when the vibratory portion of the body in contact with the first light-emitting device vibrates at a first predetermined frequency and such that a second light is emitted from a second light-emitting device of the plurality of light-emitting devices as a second color to the same naked human eye when the vibratory portion of the body in contact with the second light-emitting device vibrates at a second predetermined frequency.

In accordance with another aspect of the technology, a frequency detection and display device may include a body. The body may include a first section and a second section directly attached to the first section. The first section of the body may have a first property, and the second section may have a second property different than the first property such that a vibration received by the body at a first predetermined frequency vibrates the second section at an amplitude different than an amplitude at which the vibration received by the body at the first predetermined frequency vibrates the first section. In this manner, the device may provide a visible indication corresponding to the first predetermined frequency.

In some arrangements, the first and the second properties may be any one or any combination of physical and chemical properties. In some arrangements, the first and the second properties may be densities of the respective first and second sections of the body. In some arrangements, the first property may be a first thickness of the first section of the body, and the second property may be a second thickness of the second section of the body that is different than the first thickness.

In some arrangements, the first thickness may be defined by a first surface of the body separated from a second surface of the body, and the second thickness may be defined by a third surface of the body separated from the second surface of the body. In some such arrangements, the difference between the first thickness and the second thickness may be less than or equal to 20 nm, and in some such arrangements, may be less than or equal to 10 nm.

In some arrangements, the first section and the second section may define a groove in or an embossment of the body. In some arrangements, the groove or embossment may be in the shape of a letter. In some arrangements, the groove or embossment may be in the shape of an oval, a line, or a polygon. In some arrangements, the groove or embossment may be curvilinear.

In some arrangements, the first thickness may be defined by a first surface of the body separated from a second surface of the body, and the second thickness may be defined by a third surface of the body separated from the second surface of the body. In such arrangements, the third surface may be formed by removing material from an in-process body using ALE or an atomic level chemical etching process or by adding a precise amount of material to an in-process or existing surface of the body using ALD. In some such arrangements, the third surface may be formed by the removal of at least two layers using ALE.

In some arrangements, the body may include a third section and a fourth section directly attached to the third section. The third section may have a third thickness and the fourth section may have a fourth thickness different than the third thickness such that a vibration received by the body at a second predetermined frequency vibrates the fourth section at an amplitude different than an amplitude at which the vibration received by the body at the second predetermined frequency vibrates the third section. In this manner, the frequency detection and display device may provide a visible indication corresponding to the second predetermined frequency.

In some arrangements, the first section and the third section may be the same section. In some arrangements, a vibration received by the body at the second predetermined frequency may vibrate the fourth section at an amplitude greater than an amplitude at which the vibration received by the body at the second predetermined frequency may vibrate the third section. In some such arrangements, a vibration received by the body at the first predetermined frequency may vibrate the second section at an amplitude greater than an amplitude at which the vibration received by the body at the first predetermined frequency may vibrate the first section.

In some arrangements, the body may be attachable to a separate object such that the body may receive vibration from the separate object. In some such arrangements, the separate object may be a stringed musical instrument.

In some arrangements, the frequency detection and display device may further include an intermediate attachment device that may be attached to the body for attachment to the separate object. In some arrangements, the body may be in the form of a patch.

In some arrangements, the frequency detection and display device may further include a first light-emitting device that may be attached to the body. In some such arrangements, the first light-emitting device may contact the second section of the body. In this manner, vibration of the body at the first predetermined frequency may vibrate the second section such that the first light-emitting device emits a first light.

In some such arrangements, the body may include a third section and a fourth section directly attached to the third section. The third section may have at least a portion with a third thickness, and the fourth section may have a fourth thickness such that a vibration received by the body at a second predetermined frequency vibrates the fourth section at an amplitude different than an amplitude at which the vibration received by the body at the second predetermined frequency vibrates the third section. In this manner, the frequency detection and display device may provide a visible indication corresponding to the second predetermined frequency. In some such arrangements, the frequency detection and display device may further include a second light-emitting device that may be attached to the body. In some such arrangements, the second light-emitting device may contact the fourth section of the body. In this manner, vibration of the body at the second predetermined frequency may vibrate the fourth section such that the second light-emitting device may emit a second light. In some such arrangements, the first section and the third section may be the same section.

In some arrangements including the first and the second light-emitting devices, a vibration received by the body at the second predetermined frequency may vibrate the fourth section at an amplitude greater than an amplitude at which the vibration received by the body at the second predetermined frequency vibrates the third section. In some such arrangements, a vibration received by the body at the first predetermined frequency may vibrate the second section at an amplitude greater than an amplitude at which the vibration received by the body at the first predetermined frequency vibrates the first section.

In some arrangements including the first and the second light-emitting devices, the first light may be emitted as a first color to a naked human eye and the second light may be emitted as a second color to the same naked human eye.

In accordance with another aspect of the technology, a musical tuning combination may include a stringed musical instrument and a frequency detection and display device. The stringed musical instrument may vibrate at a range of frequencies including a first predetermined frequency. The frequency detection and display device may include a body. The body may include a first section and a second section directly attached to the first section. The first section of the body may have a first property, and the second section may have a second property different than the first property such that a vibration received by the body at the first predetermined frequency vibrates the second section at an amplitude different than an amplitude at which the vibration received by the body at the first predetermined frequency vibrates the first section. In this manner, the device may provide a visible indication corresponding to the first predetermined frequency.

In some arrangements, the first and the second properties may be any one or any combination of physical and chemical properties. In some arrangements, the first and the second properties may be densities of the respective first and second sections of the body. In some arrangements, the first property may be a first thickness of the first section of the body, and the second property may be a second thickness of the second section of the body that is different than the first thickness.

In some arrangements, the first thickness may be defined by a first surface of the body separated from a second surface of the body, and the second thickness may be defined by a third surface of the body separated from the second surface of the body. In some such arrangements, the difference between the first thickness and the second thickness may be less than or equal to 20 nm, and in some such arrangements, may be less than or equal to 10 nm.

In some arrangements, the first section and the second section may define a groove in or an embossment of the body. In some arrangements, the groove or embossment may be in the shape of a letter. In some arrangements, the groove or embossment may be in the shape of an oval, a line, or a polygon. In some arrangements, the groove or embossment may be curvilinear.

In some arrangements, the first thickness may be defined by a first surface of the body separated from a second surface of the body, and the second thickness may be defined by a third surface of the body separated from the second surface of the body. In such arrangements, the third surface may be formed by removing material from an in-process body using ALE or an atomic level chemical etching process or by adding a precise amount of material to an in-process or existing surface of the body using ALD. In some such arrangements, the third surface may be formed by the removal of at least two layers using ALE.

In some arrangements, the body may include a third section and a fourth section directly attached to the third section. The third section may have a third thickness and the fourth section may have a fourth thickness different than the third thickness such that a vibration received by the body at a second predetermined frequency vibrates the fourth section at an amplitude different than an amplitude at which the vibration received by the body at the second predetermined frequency vibrates the third section. In this manner, the frequency detection and display device may provide a visible indication corresponding to the second predetermined frequency.

In some arrangements, the first section and the third section may be the same section. In some arrangements, a vibration received by the body at the second predetermined frequency may vibrate the fourth section at an amplitude greater than an amplitude at which the vibration received by the body at the second predetermined frequency may vibrate the third section. In some such arrangements, a vibration received by the body at the first predetermined frequency may vibrate the second section at an amplitude greater than an amplitude at which the vibration received by the body at the first predetermined frequency may vibrate the first section.

In some arrangements, the frequency detection and display device may further include an intermediate attachment device that may be attached to the body for attachment to the separate object. In some arrangements, the body may be in the form of a patch. In some arrangements, the body may form part of a main housing of the stringed musical instrument, e.g., the body of a guitar.

In some arrangements, the frequency detection and display device may further include a first light-emitting device that may be attached to the body. In some such arrangements, the first light-emitting device may contact the second section of the body. In this manner, vibration of the body at the first predetermined frequency may vibrate the second section such that the first light-emitting device emits a first light.

In some such arrangements, the body may include a third section and a fourth section directly attached to the third section. The third section may have at least a portion with a third thickness, and the fourth section may have a fourth thickness such that a vibration received by the body at a second predetermined frequency vibrates the fourth section at an amplitude different than an amplitude at which the vibration received by the body at the second predetermined frequency vibrates the third section. In this manner, the frequency detection and display device may provide a visible indication corresponding to the second predetermined frequency. In some such arrangements, the frequency detection and display device may further include a second light-emitting device that may be attached to the body. In some such arrangements, the second light-emitting device may contact the fourth section of the body. In this manner, vibration of the body at the second predetermined frequency may vibrate the fourth section such that the second light-emitting device may emit a second light. In some such arrangements, the first section and the third section may be the same section.

In some arrangements including the first and the second light-emitting devices, a vibration received by the body at the second predetermined frequency may vibrate the fourth section at an amplitude greater than an amplitude at which the vibration received by the body at the second predetermined frequency vibrates the third section. In some such arrangements, a vibration received by the body at the first predetermined frequency may vibrate the second section at an amplitude greater than an amplitude at which the vibration received by the body at the first predetermined frequency vibrates the first section.

In some arrangements including the first and the second light-emitting devices, the first light may be emitted as a first color to a naked human eye and the second light may be emitted as a second color to the same naked human eye.

In accordance with another aspect of the technology, a musical instrument with an integrated, i.e., built-in, musical tuning device formed at a surface of the instrument includes a body. The body includes a first vibratory portion that vibrates at different frequencies during tuning of the instrument and one or more additional vibratory portions configured for vibrating at one or more predetermined frequencies to provide visible indications corresponding to the respective one or more predetermined frequencies in response to vibration of the first portion during the tuning of the instrument.

BRIEF DESCRIPTION OF THE DRAWINGS

An appreciation of the subject matter of the present technology and various advantages thereof may be realized by reference to the following detailed description and the accompanying drawings, in which.

DETAILED DESCRIPTION

Figure 1:
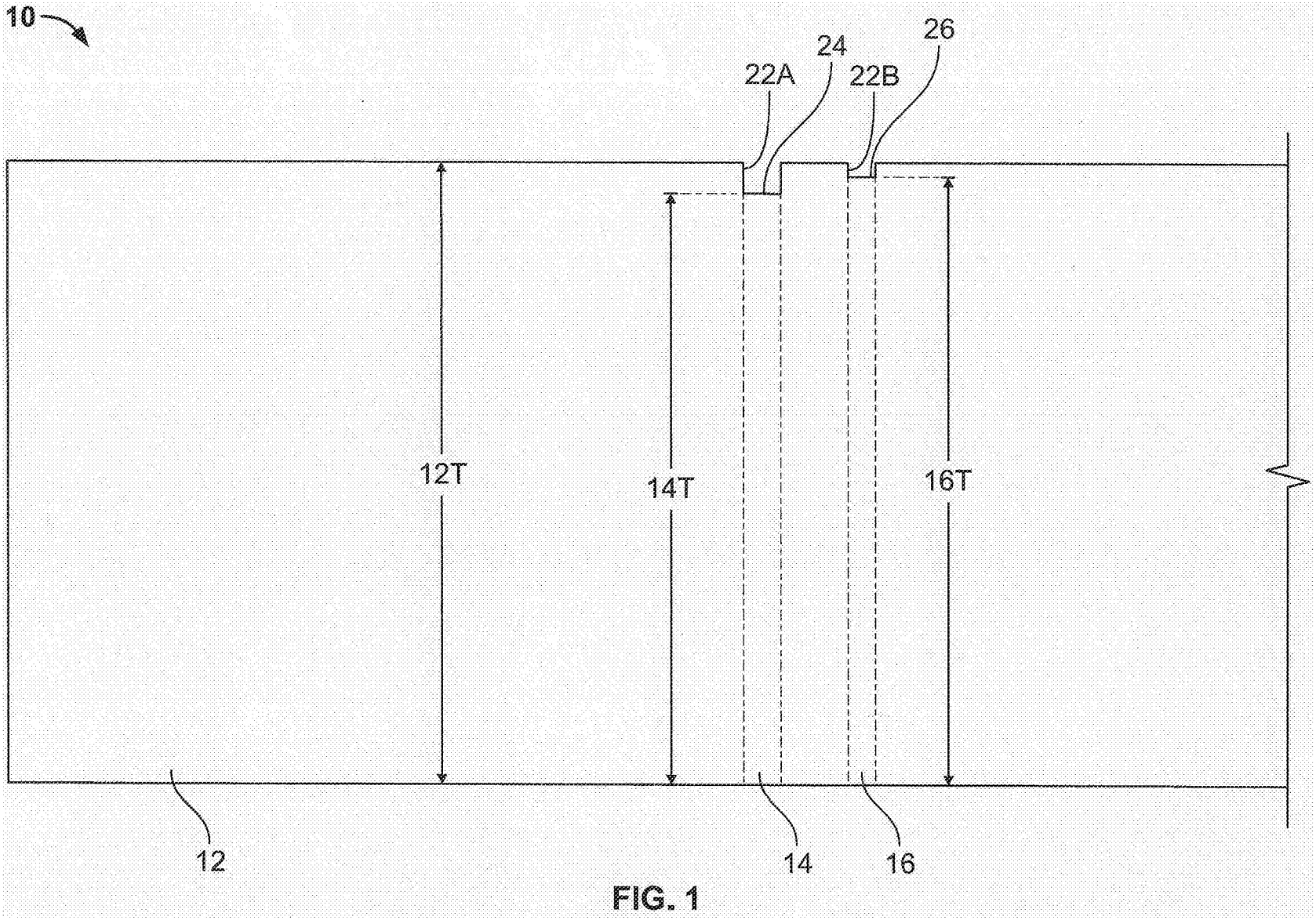
FIG. 1 is an elevation view of a body defining grooves in accordance with an embodiment of the technology.

As used above and further herein, the term "naked human eye" refers to a human eye that is seeing objects without the use of any magnification device or other magnification means.

A frequency detection and display device in accordance with an aspect of the technology includes a body that may have one or more vibratory portions configured for vibrating at a first predetermined frequency to provide a first visible indication corresponding to the first predetermined frequency in response to a first vibration received by the body. Any one or any combination of these same vibratory portions or another one or other vibratory portions may be configured for vibrating at a second predetermined frequency to provide a second visible indication corresponding to the second predetermined frequency in response to a second vibration received by the body. In this manner, the frequency detection and display device is powered passively, utilizing only mechanical vibration received by the body.

In some arrangements, the vibratory portions of the body configured for vibration to provide a visible indication may have different chemical or physical properties from other adjacent portions of the body. For example, a vibratory portion may be made of a different material, and thus may have a different density or other physical property, than an adjacent portion or adjacent portions of the body. In another example, a vibratory portion may have a different thickness than an adjacent portion or adjacent portions of the body. Such different thicknesses may be formed by removing or adding material to an existing surface of the body by any appropriate process, such as but not limited to deposition processes including chemical vapor deposition (CVD) and physical vapor deposition (PVD) or etch processes including chemical etching. For applications requiring high resolution tuning, material may be added to or removed from the existing surface of the body by a very small amount, which may be at an atomic level. For example, a precise amount of material may be removed from an existing surface of the body using atomic layer etch (ALE) or using an atomic level chemical etching process, and a precise amount of material may be added to an existing surface of the body using atomic layer deposition (ALD). In this manner, precise changes in input frequencies to the body may be detected. In some arrangements, a small amount of a different material, which may be at an atomic level, may replace the existing surface of the body.

In some arrangements, the frequency detection and display device, i.e., unit, may be in the form of a patch or other small unit constituting a body, although the preparation of larger units are within the scope of this technology as needed, e.g., for the detection and identification of predetermined frequencies on bridges, buildings, and other architectural structures. Such a unit may be attachable to a device to be tuned, e.g., a tunable musical instrument, or another device for which frequency is to be detected and identified. The unit may be attached to the other device to be tuned using any type of attachment mechanism, such as by but not limited to being by any one of or any combination of an adhesive and one or more fasteners such as screws. Due to the ability of such a unit to be of relatively small size, the unit may be attached to the other device at a location such that the unit is out of plain view.

In such arrangements in which the frequency detection and display device is in the form of a patch, vibratory portions may be formed into or onto an existing surface of the body. The vibratory portions may be formed such that they vibrate at respective predetermined frequencies to provide visible indications corresponding to the predetermined frequencies in response to vibration of the device to which the body of the frequency detection and display device is attached, i.e., in response to the same input frequency. Any vibratory portion may be in the form of a line, a regular shape such as an oval, a circle, or a polygon, or an irregular shape, e.g., a musical clef or a hazard or other danger symbol. In some arrangements, a collection of vibratory portions configured to vibrate at the same or approximately the same amplitude in response to the same input frequency may be placed adjacent to each other such that the collection together resemble a shape, e.g., a collection of lines that together resemble the letter "A."

In some arrangements, the frequency detection and display device may be integrated and thus inseparable from a device for which frequency is to be detected and identified, e.g., for tuning such device. In some such arrangements, vibratory portions may be formed into or onto the device for which frequency is to be detected and identified in the same manner such portions may be formed into or onto the body when the frequency detection and display device is in the form of a patch or other separate unit. For example, one or more grooves may be formed into a surface of a stringed musical instrument, e.g., a guitar, such that the one or more grooves vibrate at a predetermined frequency to provide a visible indication corresponding to the predetermined frequency in response to vibration of the stringed musical instrument.

As shown in FIG. 1, in one example of the present technology in the form of a patch, a small unit to clip onto a musical instrument or other vibration-controllable device, or even as part of a vibration-controllable device, body 10 includes first section 12 and second section 14 and further may include additional sections, such as additional section 16 shown in this example. First section 12 has a first thickness 12T, second section 14 has a thickness 14T and additional section 16 has a thickness 16T (thicknesses 14T and 16T not being drawn to scale relative to thickness 12T for purposes of illustration). Due to the differences in relative thickness between first section 12 and second section 14, when body 10 is vibrated at a first predetermined frequency, which preferably is a resonant frequency of second section 14, second section 14 vibrates at an amplitude greater than an amplitude that first section 12 vibrates. In this manner, second section 14 defines an indicium corresponding to only the first predetermined frequency. This passive and completely mechanical indicium is preferably visible to a naked human eye.

Similarly, due to the differences in relative thickness between first section 12 and additional section 16, when body 10 is vibrated at an additional predetermined frequency, which preferably is a resonant frequency of additional section 16, additional section 16 vibrates at an amplitude greater than an amplitude that first section 12 vibrates. In this manner, additional section 16 defines an indicium corresponding to only the additional predetermined frequency. This indicium is preferably visible to a naked human eye. Moreover, due to the differences in relative thickness between second section 14 and additional section 16, second section 14 and additional section 16 may vibrate at different amplitudes at the first and the additional predetermined frequencies such that the indicium that second section 14 defines at the first predetermined frequency is detectable to a naked human eye only at the first predetermined frequency and the indicium that additional section 16 defines at the additional predetermined frequency is detectable to a naked human eye only at the additional predetermined frequency.

As shown in the example of FIG. 1, edge 22A of first section 12 and first exposed surface 24 of section 14 may define a first groove. Similarly, edge 22B of first section 12 and additional exposed surface 26 of additional section 16 may define an additional groove. In this manner, the indicia defined by second section 14 and additional section 16 may be provided by vibration of first exposed surface 24 and additional exposed surface 26, respectively, when the second section and the additional section are excited by respective vibrations of the body. In some processes for preparing body 10, the first and the second groove may be prepared using an appropriate material removal process, such as an etching process including but not limited to the ALE process.

In an alternative arrangement, the body may be configured to have a uniform thickness such that an entire surface or entire surfaces of the body vibrate visibly to the naked human eye when subjected to vibration at a predetermined frequency. In some such arrangements, the body may be configured such that a resonant frequency of the body is the predetermined frequency.

Figure 2:
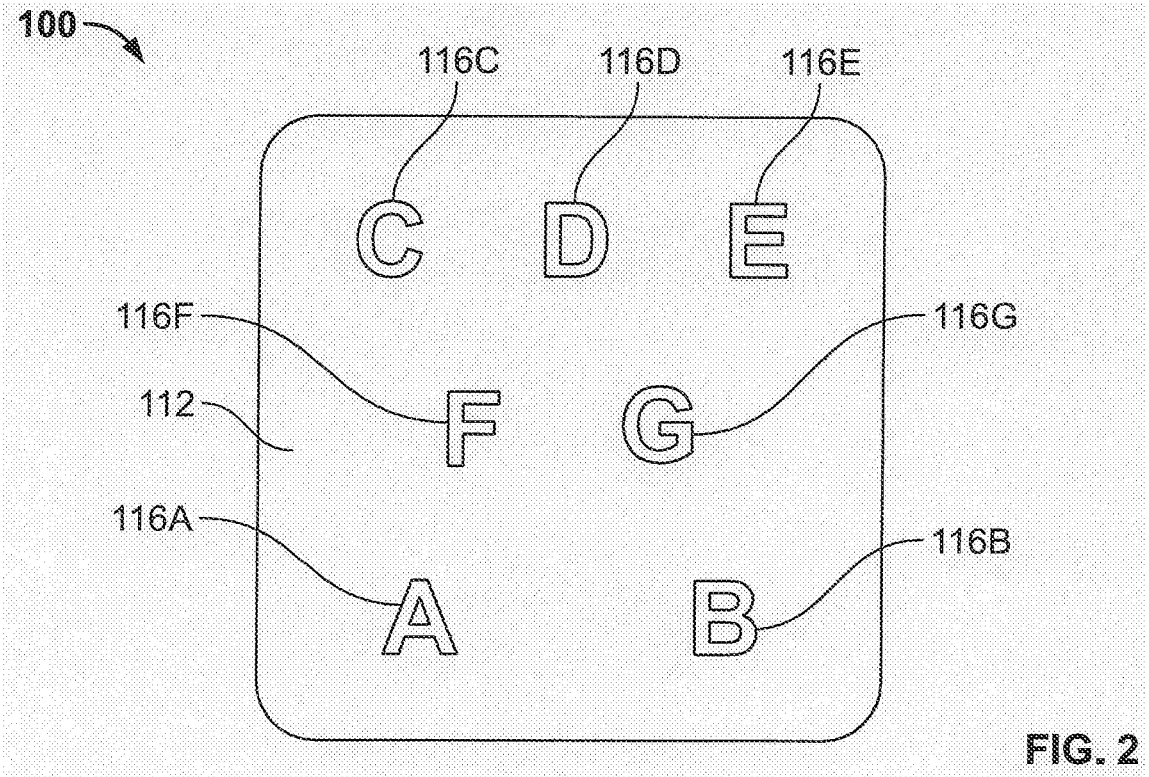
FIG. 2 is a plan view of a musical instrument tuner in accordance with another embodiment of the technology.

Referring now to FIG. 2, in another example, body 100, which is in the form of a patch, includes first section 112 and additional sections 116A-116G which extend through a thickness of body 100, i.e., in a direction perpendicular to the top surface of body 100 shown in FIG. 2. In the same manner that second section 14 and additional section 16 vibrate relative to first section 12 of body 10 and vibrate relative to each other at the first and the additional predetermined frequencies, additional sections 116A-116G vibrate at respective predetermined frequencies with amplitudes that are greater than the amplitudes that the other sections including first section 112 vibrate at those predetermined frequencies. These larger vibrations of additional sections 116A-116G preferably may be visible to a naked human eye.

As further shown, additional sections 116A-116G define grooves within first section 112 that are in the form of letters Like second section 14 and additional section 16 have different thicknesses relative to first section 12 of body 10 and relative to each other, additional sections 116A-116G have different thicknesses relative to first section 112 and relative to each other such that additional sectional sections 116A-116G vibrate at the respective predetermined frequencies with amplitudes that are greater than the amplitudes that the other sections including first section 112 vibrate at those predetermined frequencies.

In the configuration shown, body 100 may be a musical instrument tuner and the respective predetermined frequencies at which additional sections 116A-116G vibrate may correspond to the tuning frequencies of notes A-G, e.g., 440 Hz for tuning reference note A. Body 100 may be attached to a stringed musical instrument, such as by any form of attachment known to those skilled in the art including but not limited to by one or more fasteners, by an adhesive, by being clipped onto the instrument, or by being snapped onto the instrument. Additional sections 116A-116G should be prepared, as necessary, to account for any alteration of the effect of input frequencies on the predetermined frequencies caused by the form of attachment. In this manner, body 100 may be used to tune the stringed musical instrument.

Figure 3:
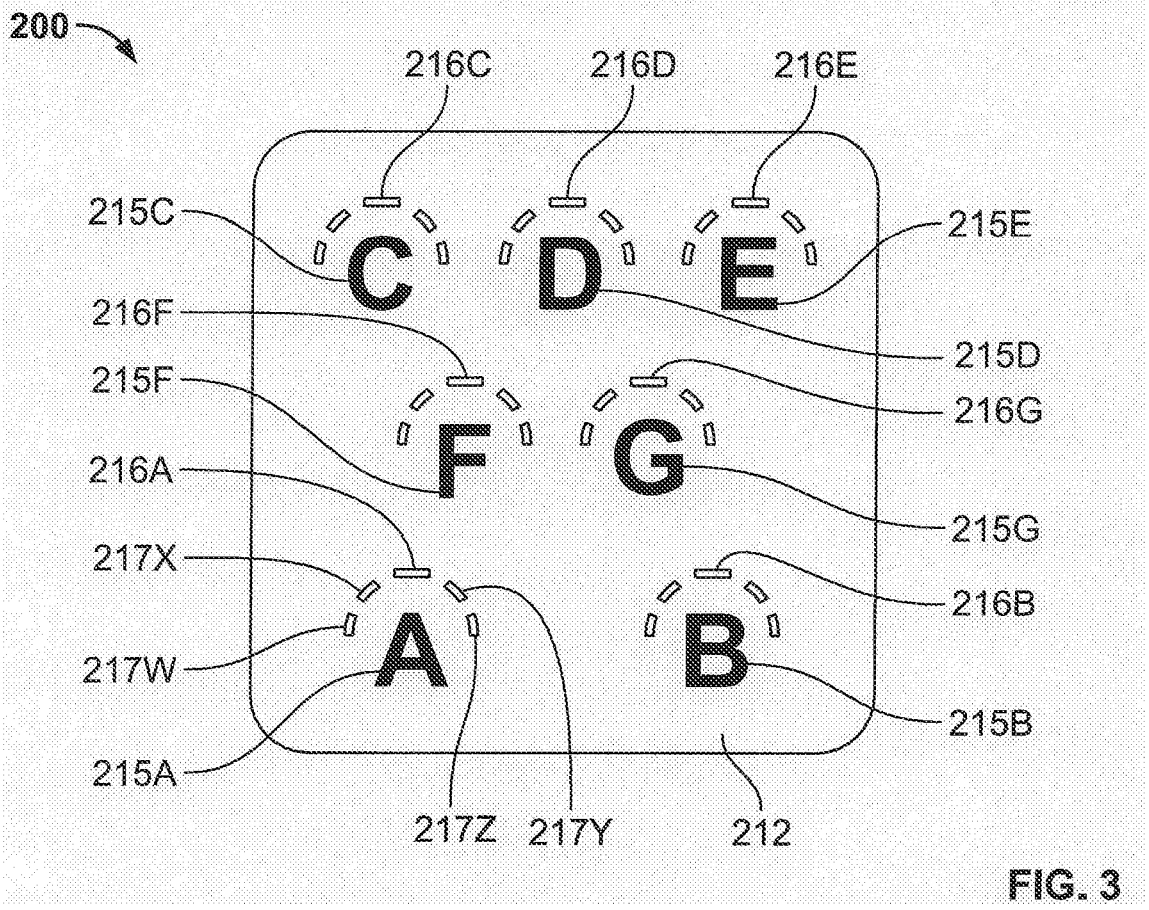
FIG. 3 is a plan view of a musical instrument tuner in accordance with yet another embodiment of the technology.

Referring now to FIG. 3, in yet another example, body 200 functions similarly to body 100 and is also in the form of a patch. In contrast to having grooves in the form of letters as in body 100, body 200 has grooves that are associated with letters (or which in alternative arrangements, could be other symbols or designations), in this example the letters A-G designated as 215A-215G, formed in the body without any significant deformation of the body. Central grooves 216A-216G within section 212 of body 200 define different respective thicknesses in a direction perpendicular to a top surface of body 200 shown in FIG. 3 that correspond to the tuning frequencies of notes A-G. Each central groove has two adjacent grooves on each side for a total of five grooves associated with each letter in which each of the adjacent grooves corresponds to a frequency that approximates but is not the same as the tuning frequencies. For example, central groove 216A has adjacent grooves 217W-217Z in which (i) groove 217W corresponds to a frequency greater than the frequency associated with groove 216A, (ii) groove 217X corresponds to a frequency less than the frequency to which groove 217W corresponds but still greater than the frequency associated with groove 216A, (iii) groove 217Y corresponds to a frequency less than groove 216A, and (iv) and groove 217Z corresponds to a frequency less than groove 217Y. For example, groove 217W may correspond to (and thus vibrate noticeably to a human naked eye at) a frequency of 444 Hz, groove 217X may correspond to a frequency of 442 Hz, groove 217Y may correspond to a frequency of 438 Hz, and groove 217Z may correspond to a frequency of 436 Hz when groove 216A corresponds to a frequency of 440 Hz to provide respective indicia at each of these frequencies noticeable to a human naked eye.

In alternative arrangements, the letters designated as 215A-215G may be grooves in the same form as additional sections 116A-116G shown in the example of FIG. 2. In this manner, the grooved alternative arrangement of letters 215A-215G may be set at a depth such that the letters vibrate noticeably to a human naked eye preferably at the same frequency that corresponding grooves 216A-216G noticeably vibrate, although in further alternative arrangements, letters 215A-215G could be set to noticeably vibrate at other predetermined frequencies as desired.

Figure 4:
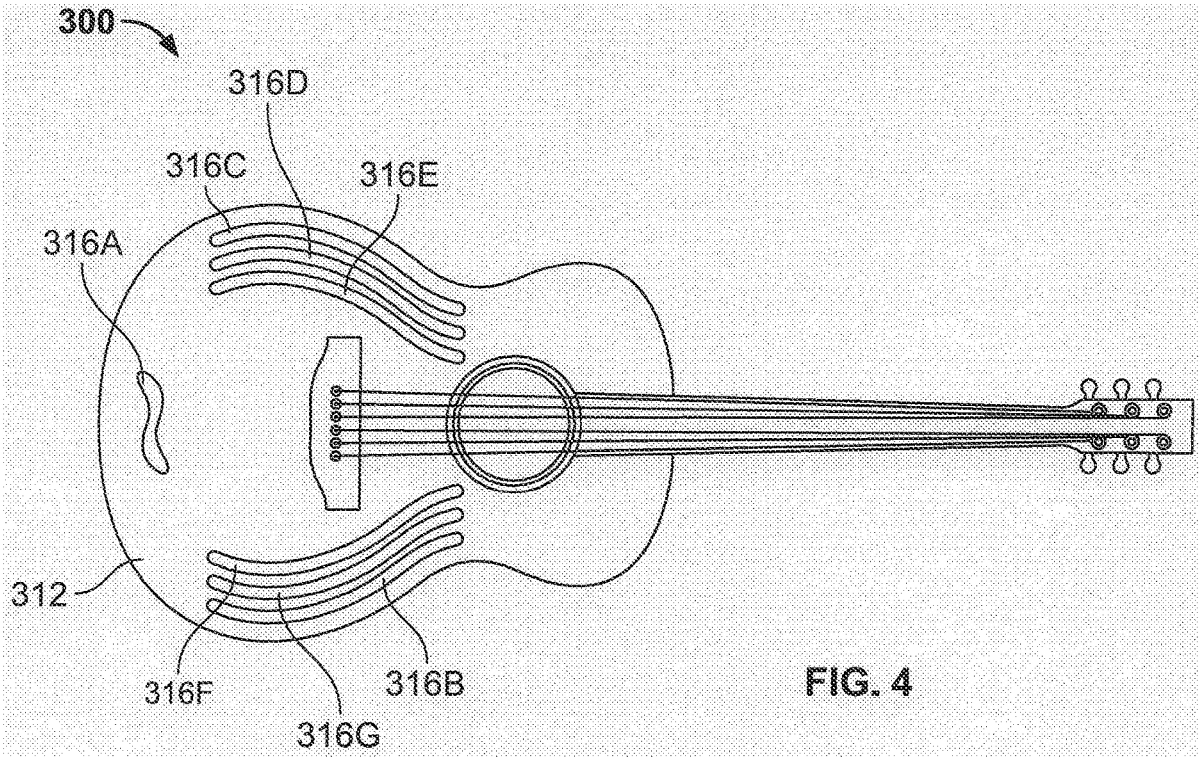
FIG. 4 is a plan view of a musical instrument in accordance with yet another embodiment of the technology.

Referring now to FIG. 4, in another example, body 300 is a stringed musical instrument. Similar to the other bodies described previously herein, body 300 includes grooves 316A-316G within main section 312 that vibrate at respective predetermined frequencies to provide a visible indication. Although grooves 316A-316G are shown with a wave profile, they may have any other profile, e.g., a circle, an oval, a polygon, or an irregular shape. In some arrangements, light emitting devices may be placed in contact with grooves 316A-316G. For example, such light emitting devices may be placed into grooves 316A-316G. In this manner, vibration caused by grooves 316A-316G may cause light to be emitted by such light emitting devices. Light emitting devices as described herein may include but are not limited to including light emitting diodes (LEDs) along with piezoelectronic generators used to convert the mechanical energy produced by the vibration of the grooves into electrical energy to power the LEDs. In some arrangements, the vibration may stimulate electrical components to induce a current that causes the light to be emitted.

Figure 5:
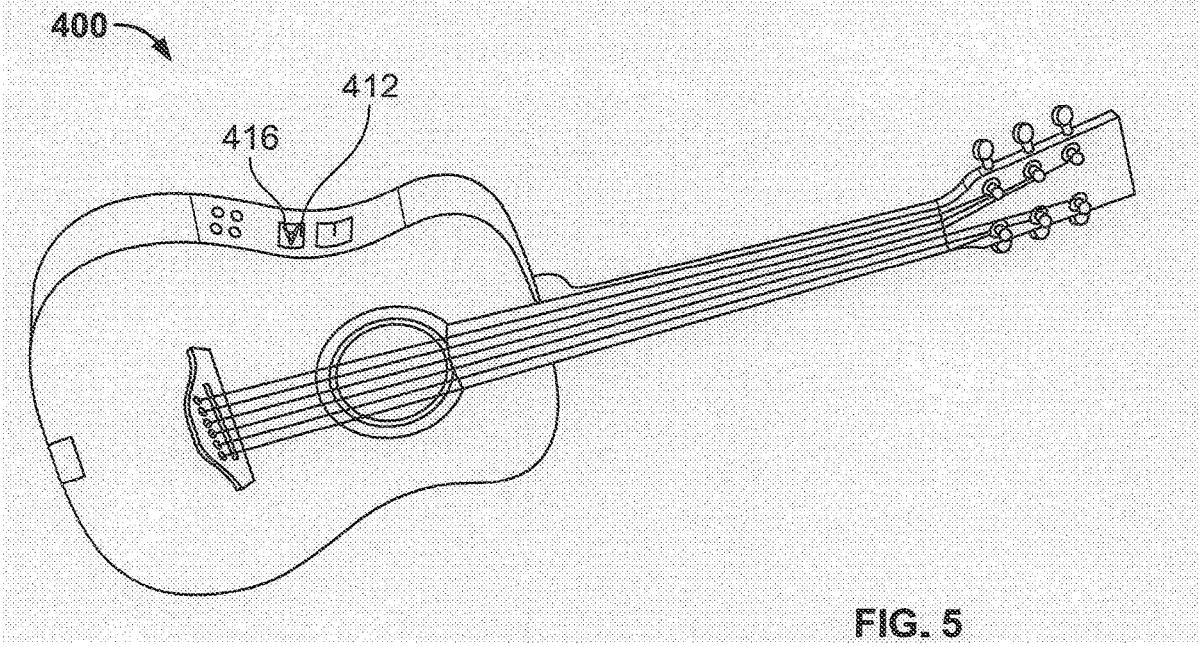
FIGS. 5-7 are perspective views of respective musical instruments in accordance with further embodiments of the technology.

As shown in FIG. 5, in another example, body 400 is another stringed musical instrument which includes groove 416 formed into main section 412 on a side of the body that, in a similar manner to other grooves and vibratory sections described previously herein, vibrates at a predetermined frequency to provide an indication visible to the naked human eye. In this manner, the provided visible indication may be visible only to the user of body 400. As in the example shown, groove 416 may be in the form of an "A" that vibrates to provide a visibly vibrating "A" upon vibration of body 400 at the predetermined frequency, which for example may be 440 Hz corresponding to the tuning frequency for reference note A. In some arrangements, as in the example shown in FIG. 5, main section 412 and groove 416 may be separable from the body, such as in the form of a patch attachable to the body.

Figure 6:
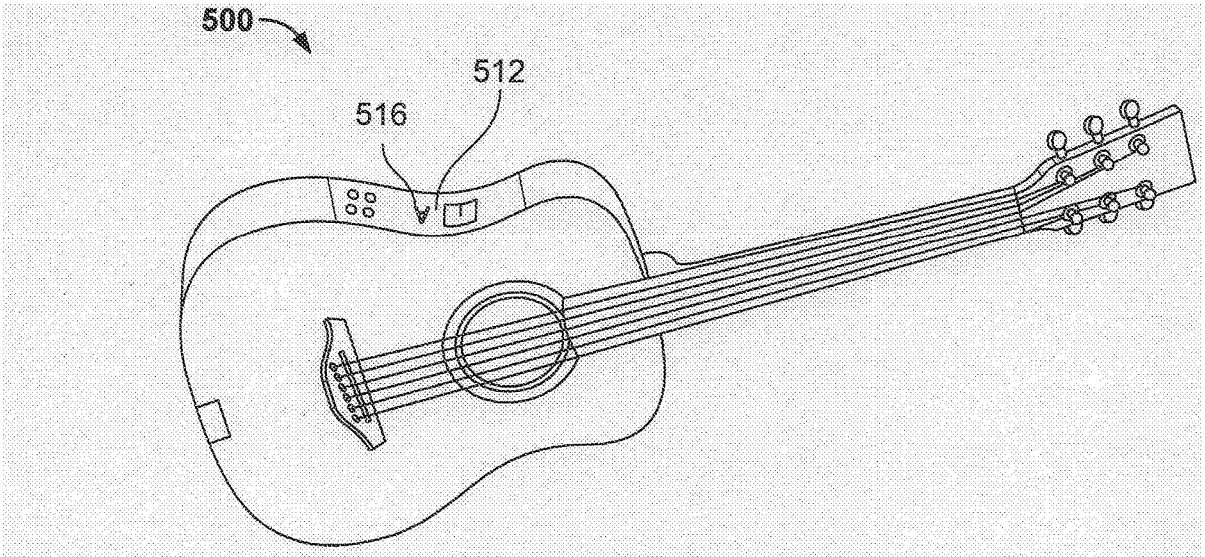

In an alternative arrangement to body 400, as shown in FIG. 6, body 500 is the same as body 400 with the exception that body 500 includes main section 512 forming the side of the body and groove 516 formed into the main section 512 such that the main section and the groove are integral and inseparable from body 500. In this configuration, groove 516 vibrates at a predetermined frequency in a similar manner to other grooves and vibratory sections described previously herein to provide an indication visible to the naked human eye. This configuration replaces the patch with main section 412 and groove 416.

Figure 7:
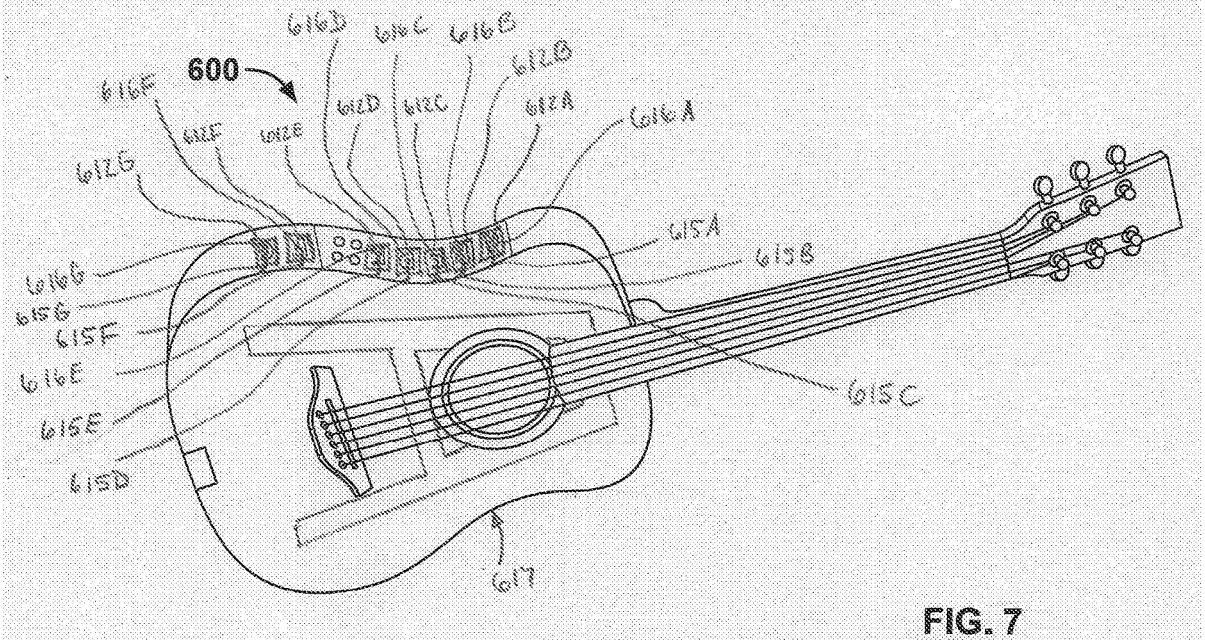

Referring now to FIG. 7, in another example, body 600 is another stringed musical instrument. Body 600 includes main sections 612A-612G and corresponding grooves 616A-616G formed into the respective main sections on a side of the body that, in a similar manner to other grooves and vibratory sections described previously herein, vibrate at respective predetermined frequencies to provide indications visible to the naked human eye. In this manner, these provided visible indications may be visible only to the user of body 600. As in the example shown, grooves 616A-616G may be in the form of the respective letters A-G and may vibrate to provide the respective visibly vibrating letters "A," "B," "C," "D," "E," "F," and "G" upon vibration of body 600 at the respective predetermined frequencies, which for example may be 440 Hz corresponding to the tuning frequency for reference note A. As in this example, main sections 612A-612G and grooves 616A-616G may be separable from the body, such as in the form of a patch attachable to the body, although in alternative arrangements, the main sections and the grooves may be integral with body 600 such that they are inseparable from the body.

Sensors, which may be piezoelectric sensors, in contact with grooves 616A-616G detect vibration of grooves 616A-616G. The sensors are electrically connected to one end of respective wires 615A-615G. Display device 617 is attached to an opposing end of respective wires 615A-616G. Display device 617 may include a microcontroller that receives electrical signals corresponding to electrical signals transmitted over respective wires 615A-615G from the sensors. The microcontroller then instructs a visual display of display device 617 to display the note, i.e., letter, corresponding to the one of grooves 616A-616G that vibrated and caused the electrical signal to be transmitted over the respective wire. The visual display of display device 617 may, in some arrangements, cover most or all of a surface of an object such as a stringed musical instrument and may be but is not limited to being a liquid crystal display (LCD) device or LED display device. In the example shown in FIG. 7, the microcontroller instructed an "A" to be displayed on an LCD screen forming almost an entirety of a surface of a stringed musical instrument in response to body 600 receiving a vibration at the respective predetermined frequency associated with the letter "A," which again may be 440 Hz corresponding to the tuning frequency for reference note A. As a result, the visual display of display device 617 shows an "A" over a large surface area of the guitar.

In alternative arrangements of bodies 100, 200, 300, 400, 500, any of the grooves may be replaced with either or both of (i) deposited material applied to a body such that these sections rise above adjacent surfaces of these sections and (ii) a different material than the adjacent surfaces of these sections. Depositing material on the body may be used to avoid deforming the body. For applications requiring high resolution tuning, the material may be but is not limited to being deposited using either or both of an atomic level process such as ALD and a three-dimensional (3D) printing process. For other applications, other deposition processes, such as but not limited to CVD and PVD, may be sufficient.

In some processes for preparing bodies 200, 300, 400, as in the process for preparing body 100, any one or any combination of the grooves may be prepared using an appropriate material removal process, such as an etching process including but not limited to any one or any combination of the ALE and atomic level chemical etching processes.

In the examples of bodies 100, 200, 300, the bodies were used for signifying that specific musical notes had been produced by a stringed musical instrument. In other arrangements, this technology may allow for the detection and identification of specific frequencies to detect and identify the sizes or shapes of specific objects or for the detection of other features or characteristics of objects that be manifested at different input frequencies. In still other arrangements, this technology may allow for the detection of changes in frequencies of an object given the same input frequency. For example, a groove may be formed into a cutting tool in which the vibration of the groove may became greater as the tool wears and in which the groove may visibly vibrate at a frequency, e.g., a resonant frequency, generated when the tool has worn sufficiently to need replacement.

It is to be understood that the disclosure set forth herein includes all possible combinations of the particular features set forth above, whether specifically disclosed herein or not. For example, where a particular feature is disclosed in the context of a particular aspect, arrangement, configuration, or embodiment, that feature can also be used, to the extent possible, in combination with and/or in the context of other particular aspects, arrangements, configurations, and embodiments of the invention, and in the invention generally.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A frequency detection and display device powered only by mechanical vibration comprising:

a body including a first section having a first thickness and a second section directly attached to the first section and having a second thickness different than the first thickness such that a vibration received by the body at a first predetermined frequency vibrates the second section at an amplitude different than an amplitude at which the vibration received by the body at the first predetermined frequency vibrates the first section thereby providing a visible indication corresponding to the first predetermined frequency, wherein the body further includes a third section having a third thickness and a fourth section directly attached to the third section and having a fourth thickness different than the third thickness such that a vibration received by the body at a second predetermined frequency vibrates the fourth section at an amplitude different than an amplitude at which the vibration received by the body at the second predetermined frequency vibrates the third section thereby providing a visible indication corresponding to the second predetermined frequency.

2. The device of claim 1, wherein the first thickness is defined by a distance between a first surface of the body and a second surface of the body separated from the first surface, the second thickness is defined by a distance between a third surface of the body and the second surface of the body, and the difference between the first thickness and the second thickness is less than or equal to 20 nm.

3. The device of claim 1, wherein the first thickness is defined by a distance between a first surface of the body and a second surface of the body separated from the first surface, the second thickness is defined by a distance between a third surface of the body and the second surface of the body, and the difference between the first thickness and the second thickness is less than or equal to 10 nm.

4. The device of claim 1, wherein the first section and the second section each define a groove in or embossment of the body.

5. The device of claim 4, wherein the groove or embossment is in the shape of a letter.

6. The device of claim 4, wherein the groove or embossment is in the shape of an oval, a line, or a polygon.

7. The device of claim 4, wherein the groove or embossment is curvilinear.

8. The device of claim 1, wherein the first thickness is defined by a distance between a first surface of the body and a second surface of the body separated from the first surface, the second thickness is defined by a distance between a third surface of the body and the second surface of the body, and the third surface is formed by atomic layer etch (ALE).

9. The device of claim 1, wherein the third surface is formed by the removal of at least two layers using ALE.

10. The device of claim 1, wherein the first section and the third section are the same section.

11. The device of claim 1, wherein a vibration received by the body at the second predetermined frequency vibrates the fourth section at an amplitude greater than an amplitude at which the vibration received by the body at the second predetermined frequency vibrates the third section, and wherein a vibration received by the body at the first predetermined frequency vibrates the second section at an amplitude greater than an amplitude at which the vibration received by the body at the first predetermined frequency vibrates the first section.

12. The device of claim 1, wherein the body is attachable to a separate object such that the body receives vibration from the separate object.

13. The device of claim 12, wherein the separate object is a stringed musical instrument.

14. The device of claim 12, further comprising an intermediate attachment device attached to the body for attachment to the separate object.

15. The device of claim 1, wherein the body is in the form of a patch.

16. A musical tuning combination comprising:

a stringed musical instrument that vibrates at a range of frequencies including the first predetermined frequency and the second predetermined frequency; and the frequency detection and display device of claim 2 attached to the stringed musical instrument such that the vibration of the stringed musical instrument at the first predetermined frequency vibrates the second section of the frequency detection and display device at an amplitude different than an amplitude at which the vibration of the stringed musical instrument at the first predetermined frequency vibrates the first section of the frequency detection and display device and such that vibration of the stringed musical instrument at the second predetermined frequency vibrates the fourth section of the frequency detection and display device at an amplitude different than an amplitude at which the vibration of the stringed musical instrument at the second predetermined frequency vibrates the third section of the frequency detection and display device.

17. A musical instrument comprising:

the frequency detection and display device of claim 1, the body a body of the musical instrument.

* * * * *